US011427921B2

(12) United States Patent
Hoshino et al.

(10) Patent No.: US 11,427,921 B2
(45) Date of Patent: Aug. 30, 2022

(54) ELECTROLYTIC TREATMENT APPARATUS AND ELECTROLYTIC TREATMENT METHOD

(71) Applicant: Tokyo Electron Limited, Tokyo (JP)

(72) Inventors: Tomohisa Hoshino, Kumamoto (JP); Masato Hamada, Kumamoto (JP); Toshiyuki Matsumoto, Kumamoto (JP)

(73) Assignee: TOKYO ELECTRON LIMITED, Tokyo (JP)

( * ) Notice: Subject to any disclaimer, the term of this patent is extended or adjusted under 35 U.S.C. 154(b) by 352 days.

(21) Appl. No.: 16/481,939

(22) PCT Filed: Jan. 18, 2018

(86) PCT No.: PCT/JP2018/001354
§ 371 (c)(1),
(2) Date: Jul. 30, 2019

(87) PCT Pub. No.: WO2018/142955
PCT Pub. Date: Aug. 9, 2018

(65) Prior Publication Data

US 2021/0285119 A1 Sep. 16, 2021

(30) Foreign Application Priority Data

Feb. 1, 2017 (JP) ..... JP2017-016857

(51) Int. Cl.
*C25D 17/10* (2006.01)
*C25D 5/00* (2006.01)
(Continued)

(52) U.S. Cl.
CPC ..... *C25D 5/617* (2020.08); *C25D 7/123* (2013.01); *C25D 17/06* (2013.01); *C25D 17/10* (2013.01)

(58) Field of Classification Search
None
See application file for complete search history.

(56) References Cited

U.S. PATENT DOCUMENTS 8,147,660 B1 * 4/2012 Mayer ..... C25D 17/008 205/97
2016/0326663 A1 11/2016 Iwatsu
2018/0355501 A1 12/2018 Hoshino

FOREIGN PATENT DOCUMENTS

CN 1355930 * 6/2002 ..... C25D 11/022
JP 2001032098 * 2/2001 ..... C25D 17/06
(Continued)

OTHER PUBLICATIONS

English translation of TW 201538805. (Year: 2015).*
(Continued)

*Primary Examiner* — Stefanie S Wittenberg
(74) *Attorney, Agent, or Firm* — Pearne & Gordon LLP

(57) ABSTRACT

An electrolytic treatment apparatus 1 (1A) configured to perform an electrolytic treatment on a target substrate includes a substrate holder 10 and an electrolytic processor 20. The substrate holder 10 includes an insulating holding body 11 configured to hold the target substrate and an indirect negative electrode 12 disposed within the holding body 11. A negative voltage is applied to the indirect negative electrode 12. The electrolytic processor 20 is disposed to face the substrate holder 10 and configured to apply a voltage to the target substrate and an electrolyte in contact with the target substrate.

18 Claims, 9 Drawing Sheets

(51) Int. Cl.
*C25D 17/06* (2006.01)
*C25D 7/12* (2006.01)

(56) References Cited

FOREIGN PATENT DOCUMENTS

| | | | | | |
|---|---|---|---|---|---|
| JP | 2004-250747 | A | | 9/2004 | |
| JP | 2010-013680 | A | | 1/2010 | |
| KR | 10-2001-0090469 | A | | 10/2001 | |
| KR | 10-2016-0009684 | A | | 1/2016 | |
| TW | 201538805 | A | | 10/2015 | |
| WO | WO2014188897 | | * | 11/2014 | ..... C25D 5/02 |
| WO | 2015/104951 | A1 | | 7/2015 | |
| WO | 2017/094568 | A1 | | 6/2017 | |

OTHER PUBLICATIONS

English Translation JP 2001032098, 2001. (Year: 2001).*
International Search Report for PCT/JP2018/001354 dated Mar. 6, 2018.

* cited by examiner

ELECTROLYTIC TREATMENT APPARATUS AND ELECTROLYTIC TREATMENT METHOD

CROSS-REFERENCE TO RELATED APPLICATION

This Application is a U.S. national phase application under 35 U.S.C. § 371 of PCT Application No. PCT/JP2018/001354 filed on Jan. 18, 2018, which claims the benefit of Japanese Patent Application No. 2017-016857 filed on Feb. 1, 2017, the entire disclosures of which are incorporated herein by reference.

TECHNICAL FIELD

The various aspects and embodiments described herein pertain generally to an electrolytic treatment apparatus and an electrolytic treatment method.

BACKGROUND

Conventionally, there is known a method of processing a surface of a semiconductor wafer as a substrate (hereinafter, simply referred to as "wafer") by performing an electrolytic treatment while bringing the wafer into contact with an electrolyte. An example of such an electrolytic treatment is a plating processing of forming a plating film on the surface of the wafer by performing an electrolytic treatment while bringing the wafer into contact with a plating liquid (see, for example, Patent Document 1).

PRIOR ART DOCUMENT

Patent Document 1: Japanese Patent Laid-open Publication No. 2004-250747

Means for Solving the Problems

In one exemplary embodiment, an electrolytic treatment apparatus configured to perform an electrolytic treatment on a target substrate includes a substrate holder and an electrolytic processor. The substrate holder includes an insulating holding body configured to hold the target substrate and an indirect negative electrode disposed within the holding body. A negative voltage is applied to the indirect negative electrode. The electrolytic processor is disposed to face the substrate holder and configured to apply a voltage to the target substrate and an electrolyte in contact with the target substrate.

DETAILED DESCRIPTION

Hereinafter, various exemplary embodiments of an electrolytic treatment apparatus and an electrolytic treatment method according to the present disclosure will be described in detail with reference to the accompanying drawings. Further, it should be noted that the exemplary embodiments are not intended to be anyway limiting.

First Exemplary Embodiment

Figure 1:
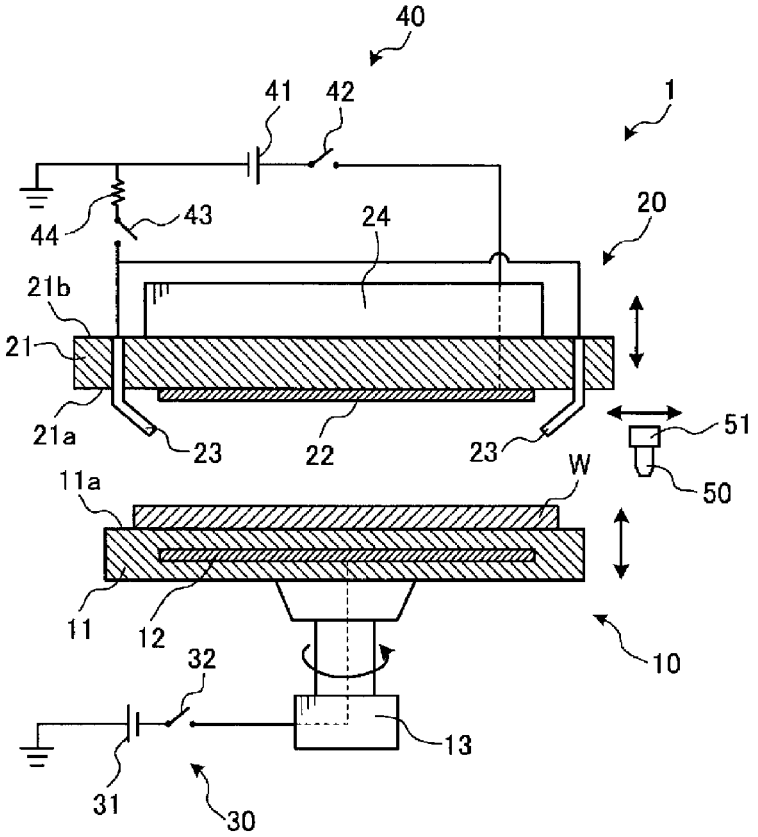
FIG. 1 is a diagram illustrating a schematic configuration of an electrolytic treatment apparatus according to a first exemplary embodiment.

First, referring to FIG. 1, a configuration of an electrolytic treatment apparatus 1 according to a first exemplary embodiment will be explained. FIG. 1 is a diagram illustrating a schematic configuration of the electrolytic treatment apparatus 1 according to the first exemplary embodiment.

In this electrolytic treatment apparatus 1, a plating processing is performed as an electrolytic treatment on a semiconductor wafer W (hereinafter, simply referred to as "wafer W") as a target substrate. In the drawings of the following description, sizes of individual constituent components do not necessarily correspond to actual sizes for the purposes of illustration to facilitate understanding of the present disclosure.

The electrolytic treatment apparatus 1 is equipped with a substrate holder 10 and an electrolytic processor 20. The electrolytic treatment apparatus 1 is further equipped with an indirect voltage applying device 30, a direct voltage applying device 40 and a nozzle 50.

The substrate holder 10 has a function of holding the wafer W. The substrate holder 10 is equipped with a holding body 11, an indirect negative electrode 12 and a driver 13.

The holding body 11 is, for example, a spin chuck configured to hold and rotate the wafer W. The holding body 11 is of a substantially circular plate shape, and has a top surface 11*a* which has a diameter larger than a diameter of the wafer W and which is extending in the horizontal direction when viewed from the top. This top surface 11*a* is equipped with, for example, a suction hole (not shown) for suctioning the wafer W. The wafer W can be held on the top surface 11*a* of the holding body 11 by performing the suctioning through this suction hole.

The holding body 11 is made of an insulating material, and the indirect negative electrode 12 made of a conductive material is provided within the holding body 11. That is, the indirect negative electrode 12 is not exposed to the outside. The indirect negative electrode 12 is connected to the indirect voltage applying device 30 to be described later, and a preset negative voltage is applied to the indirect negative electrode 12.

The indirect negative electrode 12 is disposed substantially in parallel with the wafer W held on the top surface 11*a* of the holding body 11. The indirect negative electrode 12 has the substantially same size as a direct electrode 22 to be described later.

Since the substrate holder 10 is equipped with the driver 13 having a motor or the like, the holding body 11 can be rotated at a predetermined speed. Further, since the driver 13 is provided with an elevation driver (not shown) such as a cylinder, the holding body 11 can be moved in the vertical direction.

The electrolytic processor 20 is disposed above the substrate holder 10, facing the top surface 11*a* of the holding body 11. The electrolytic processor 20 includes a base body 21, the direct electrode 22, contact terminals 23 and a moving mechanism 24.

The base body 21 is made of an insulating material. The base body 21 has a substantially circular plate shape when viewed from the top. The base body 21 has a bottom surface 21*a* having a diameter larger than the diameter of the wafer W and a top surface 21*b* opposite to the bottom surface 21*a*.

The direct electrode 22 is made of a conductive material and is provided on the bottom surface 21*a* of the base body 21. The direct electrode 22 is disposed to face the wafer W held by the substrate holder 10 substantially in parallel therewith. When a plating processing is performed, the direct electrode 22 comes into direct contact with a plating liquid M (see FIG. 3C) accumulated on the wafer W.

The contact terminals 23 are protruded from the bottom surface 21*a* at a peripheral portion of the base body 21. Each of the contact terminal 23 is made of a conductor having elasticity and curved toward a central portion of the bottom surface 21*a*.

The number of the contact terminals 23 provided at the base body 21 is two or more, for example, thirty two. These contact terminals 23 are equi-spaced on a concentric circle when viewed from the top. Leading ends of all the contact terminals 23 are arranged such that an imaginary plane formed by the respective leading ends are substantially parallel with the surface of the wafer W held by the substrate holder 10.

When the plating processing is performed, the contact terminals 23 come into contact with a peripheral portion of the wafer W (see FIG. 3C) to apply a voltage to the wafer W. The number and the shape of the contact terminals 23 are not limited to the examples described in the exemplary embodiment.

The direct electrode 22 and the contact terminals 23 are connected to the direct voltage applying device 40 to be described later and are capable of applying a preset voltage to the plating liquid M and the wafer W respectively contacted therewith.

The moving mechanism 24 is provided on the top surface 21*b* of the base body 21. The moving mechanism 24 is equipped with an elevation driver (not shown) such as, but not limited to, a cylinder. The moving mechanism 24 is capable of moving the entire electrolytic processor 20 in the vertical direction by this elevation driver.

The indirect voltage applying device 30 includes a DC power supply 31 and a switch 32 and is connected to the indirect negative electrode 12 of the substrate holder 10. To elaborate, a cathode side of the DC power supply 31 is connected to the indirect negative electrode 12 via the switch 32, and an anode side of the DC power supply 31 is grounded.

By controlling the switch 32 on, the indirect voltage applying device 30 is capable of applying a preset negative voltage to the indirect negative electrode 12.

The direct voltage applying device 40 includes a DC power supply 41, switches 42 and 43 and a load resistor 44, and is connected to the direct electrode 22 and the contact terminals 23 of the electrolytic processor 20. To elaborate, an anode side of the DC power supply 41 is connected to the direct electrode 22 via the switch 42, and a cathode side of the DC power supply 41 is connected to the contact terminals 23 via the switch 43 and the load resistor 44. Further, the cathode side of the DC power supply 41 is grounded.

By turning the switches 42 and 43 into an on state or an off state at the same time, the direct voltage applying device 40 is capable of applying a voltage to the direct electrode 22 and a voltage to the contact terminals 23 in a pulse shape.

Figure 2A:
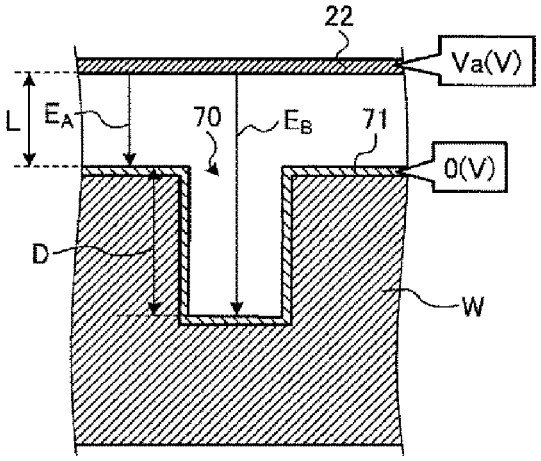
FIG. 2A is an enlarged cross sectional view schematically illustrating an electric field intensity on a wafer in a reference example.

Here, referring to FIG. 2A and FIG. 2B, an effect of filling a via 70 with a plating film 60 according to the first exemplary embodiment will be explained. FIG. 2A is an enlarged cross sectional view schematically illustrating an electric field intensity on the wafer W in a reference example. As depicted in FIG. 2A, the via 70 is formed in the surface of the wafer W, and a seed layer 71 is formed on the surface of the wafer W.

As shown in FIG. 2A, in case that the indirect negative electrode 12 is not provided in the electrolytic treatment apparatus 1, an electric field intensity $E_A$ of an electric field formed on the surface of the wafer W is defined as $E_A$=Va/L (V/cm) when Va (V) represents the voltage applied to the direct electrode 22, the voltage applied to the contact terminals 23 is set to be 0 V, and L (cm) denotes a distance between the direct electrode 22 and the surface of the wafer W.

Meanwhile, an electric field intensity $E_B$ of an electric field formed on a bottom surface of the via 70 is expressed by $E_B$=Va/(L+D)(V/cm). Here, D (cm) refers to a depth of the via 70.

Here, for example, when Va=40(V), L=1 (mm) and D=50 (μm), $E_A$ equals to 400 V/cm and $E_B$ equals to 381 V/cm. The electric field intensity $E_B$ of the electric field formed on the bottom surface of the via 70 is smaller than the electric field intensity $E_A$ of the electric field formed on the surface of the wafer W.

That is, since an electric current flowing in the bottom surface of the via 70 is smaller than an electric current flowing in the surface of the wafer W, a growth rate of the plating film 60 on the bottom surface of the via 70 is lower than a grow rate of the plating film 60 on the surface of the wafer W. Therefore, an opening of the via 70 may be closed by the plating film 60 before the inside of the via 70 is filled with the plating film 60, so that the inside of the via 70 may not be filled with the plating film 60 completely.

Now, the electric field intensity on the wafer W in the electrolytic treatment according to the first exemplary embodiment will be described. FIG. 2B is an enlarged cross sectional view schematically illustrating the electric field intensity on the wafer W according to the first exemplary embodiment. FIG. 2B illustrates an example where the indirect negative electrode 12 is disposed without a gap from a rear surface of the wafer W and the wafer W is set in a floating state.

Figure 2B:
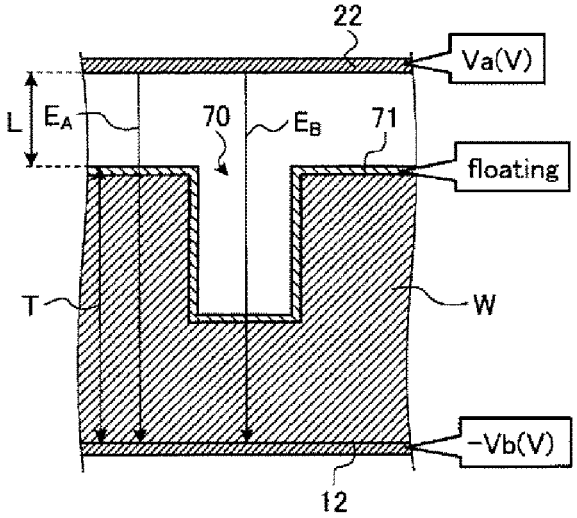
FIG. 2B is an enlarged cross sectional view schematically illustrating the electric field intensity on the wafer according to the first exemplary embodiment.

As shown in FIG. 2B, in case that the indirect negative electrode 12 is provided in the electrolytic treatment apparatus 1, the electric field intensity $E_A$ of the electric field formed on the surface of the wafer W is defined as $E_A$=(Va+Vb)/(L+T)(V/cm) when the voltage applied to the indirect negative electrode 12 is −Vb (V) and a thickness of the wafer W is T (cm).

The electric field intensity $E_B$ of the electric field formed on the bottom surface of the via 70 is defined as $E_B$=(Va+Vb)/(L+T)(V/cm). That is, in the first exemplary embodiment, the indirect negative electrode 12 is provided at the substrate holder 10, and by applying the negative voltage to the indirect negative electrode 12, the electric field intensity formed on the surface of the wafer W and the electric field intensity formed on the bottom surface of the via 70 can be made same.

Accordingly, since the growth rate of the plating film 60 on the wafer W and the growth rate of the plating film 60 in the via 70 can be made same, the opening of the via 70 can be suppressed from being clogged by the plating film 60 before the inside of the via 70 is filled with the plating film 60. Therefore, according to the first exemplary embodiment, the via 70 formed in the wafer W can be filled with the plating film 60 successfully.

Referring back to FIG. 1, the other parts of the electrolytic treatment apparatus 1 will be discussed. The nozzle 50 configured to supply the plating liquid M onto the wafer W is provided between the substrate holder 10 and the electrolytic processor 20. This nozzle 50 is provided with a moving mechanism 51, and the nozzle 50 can be moved in the horizontal direction and the vertical direction by the moving mechanism 51. That is, the nozzle 50 is configured to be movable back and forth with respect to the substrate holder 10.

Further, the nozzle 50 communicates with a plating liquid source (not shown) storing the plating liquid M therein, and the plating liquid M is supplied from the plating liquid source into the nozzle 50. In addition, in the present exemplary embodiment, although the plating liquid M is supplied onto the wafer W by using the nozzle 50, a device configured to supply the plating liquid M onto the wafer W is not limited to the nozzle, and various other devices may be used.

The electrolytic treatment apparatus 1 described so far is equipped with a controller (not shown). This controller may be, by way of non-limiting example, a computer, and has a storage (not shown).

The controller includes: a microcomputer having a CPU (Central Processing Unit), a ROM (Read Only Memory), a RAM (Random Access Memory), an input/output port, and so forth; and various kinds of circuits. The CPU of this microcomputer reads out a program stored in the ROM and executes the program, thus carrying out various kinds of controls over the individual components of the electrolytic treatment apparatus 1.

The program may be recorded on a computer-readable recording medium and installed from this recording medium to the storage. The computer-readable recording medium may be, by way of example, a hard disk (HD), a flexible disk (FD), a compact disk (CD), a magnet-optical disk (M), a memory card, or the like.

The storage is implemented by a semiconductor memory device such as, but not limited to, a RAM or a flash memory, or a storage device such as a hard disk or an optical disk.

<Details of Plating Processing>

Figure 3A:
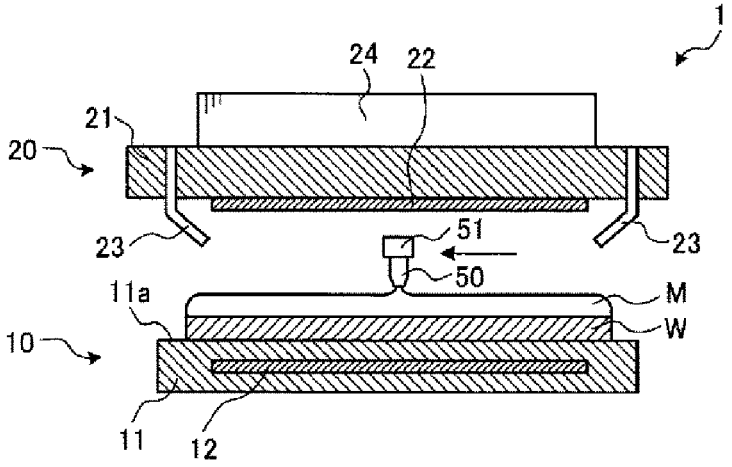
FIG. 3A is a diagram illustrating an outline of a substrate holding processing and a liquid accumulating processing according to the first exemplary embodiment.

Now, referring to FIG. 3A to FIG. 3E, details of the plating processing as the example of the electrolytic treatment in the electrolytic treatment apparatus 1 according to the first exemplary embodiment will be described. In the plating processing performed in the electrolytic treatment apparatus 1 according to the first exemplary embodiment, a substrate holding processing and a liquid accumulating processing are first performed. FIG. 3A is a diagram illustrating an outline of the substrate holding processing and the liquid accumulating processing according to the first exemplary embodiment.

First, the wafer W is transferred to and placed on the top surface 11*a* of the base body 11 of the substrate holder 10 by a non-illustrated transfer mechanism. Then, by performing the suctioning through the suction hole formed in the top surface 11*a*, for example, the electrolytic treatment apparatus 1 performs the substrate holding processing of holding the placed wafer W by the substrate holder 10.

Prior to this substrate holding processing, the via 70 (see FIG. 2B) is formed on the surface of the wafer W, and an insulating layer (not shown) such as $SiO_2$, a barrier layer (not shown) such as Ta or Ti, and the seed layer 71 (see FIG. 2B) such as Cu, Co, or Ru are formed in sequence from the bottom. Further, in case of forming a Cu film as the plating film 60 (see FIG. 3E), it may be desirable to use Ta as the barrier layer and Cu as the seed layer 71.

Following the substrate holding processing, the liquid accumulating processing is performed in the electrolytic treatment apparatus 1. First, the nozzle 50 is moved by using the moving mechanism 51 to a position above the central portion of the wafer W held by the substrate holder 10. Then, while rotating the wafer W by the driver 13, the plating liquid M is supplied to the central portion of the wafer W from the nozzle 50.

Figure 3B:
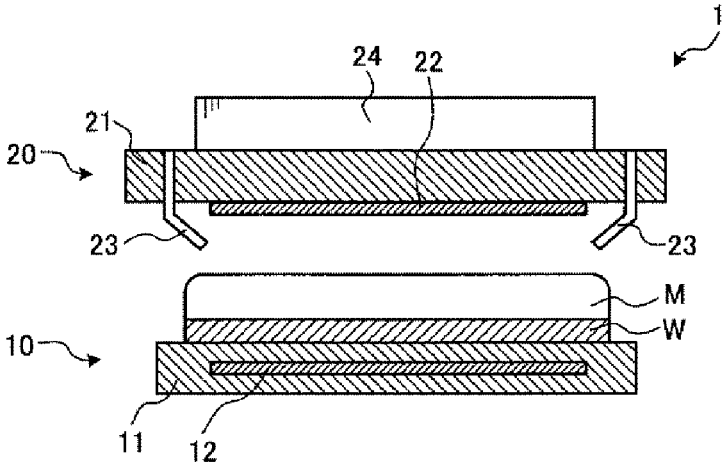
FIG. 3B is a diagram illustrating a state after the liquid accumulating processing according to the first exemplary embodiment.

Here, the supplied plating liquid M is diffused onto the entire surface of the wafer W by the centrifugal force, and is uniformly diffused on the top surface of the wafer W. Then, if the supply of the plating liquid M from the nozzle 50 is stopped and the rotation of the wafer W is stopped, the plating liquid M is accumulated on the wafer W by a surface tension of the plating liquid M, as depicted in FIG. 3B. FIG. 3B is a diagram illustrating a state after the liquid accumulating processing according to the first exemplary embodiment.

Figure 3C:
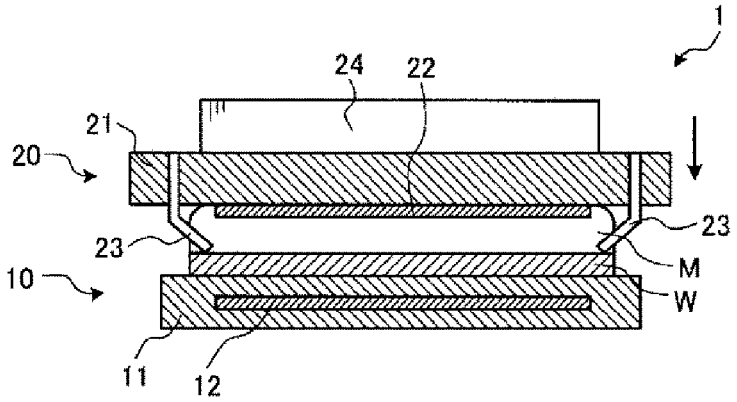
FIG. 3C is a diagram illustrating an outline of a terminal contact processing according to the first exemplary embodiment.
Figure 3D:
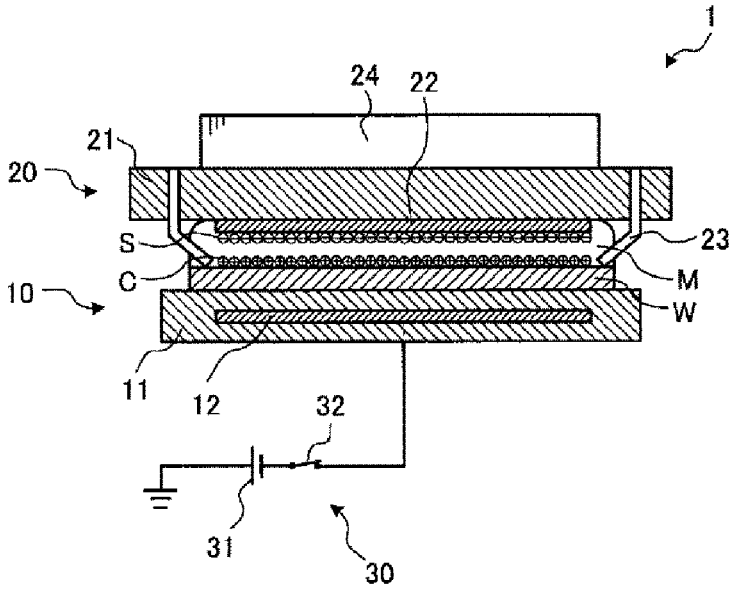
FIG. 3D is a diagram illustrating an outline of a negative voltage applying processing according to the first exemplary embodiment.

By way of example, in case of forming the Cu film as the plating film 60, the plating liquid M needs to contain copper ions C (see FIG. 3D) and sulfuric acid ions S (see FIG. 3D). A thickness of the plating liquid M after the liquid accumulating processing may be in the range from, e.g., 1 mm to 5 mm.

Further, in the liquid accumulating processing, after the plating liquid M is supplied onto the wafer W, the nozzle 50 is retreated from above the wafer W by the moving mechanism 51. Further, in the substrate holding processing and the liquid accumulating processing described so far, the electrolytic processor 20 is placed away from the substrate holder 10.

Following the liquid accumulating processing, a terminal contact processing is performed in the electrolytic treatment apparatus 1. To elaborate, the entire electrolytic processor 20 is moved by the moving mechanism 24 to approach the wafer W held by the substrate holder 10, so that the leading ends of the contact terminals 23 come into contact with the peripheral portion of the wafer W, as shown in FIG. 3C. FIG. 3C is a diagram illustrating an outline of the terminal contact processing according to the first exemplary embodiment.

In this terminal contact processing, the direct electrode 22 is brought into direct contact with the plating liquid M accumulated on the wafer W, as illustrated in FIG. 3C. That is, the aforementioned liquid accumulating processing needs to be performed while controlling the thickness of the plating liquid M appropriately so that the plating liquid M and the direct electrode 22 come into direct contact with each other when the contact terminals 23 come into contact with the wafer W.

Further, in the above-described terminal contact processing, the contact terminals 23 are brought into contact with the wafer W by allowing the entire electrolytic processor 20 to approach the wafer W by the moving mechanism 24. However, the contact terminals 23 may be brought into contact with the wafer W by allowing the holding body 11 to approach the electrolytic processor 20 by the driver 13.

Following the terminal contact processing, a negative voltage applying processing is performed in the electrolytic treatment apparatus 1. To be specific, as illustrated in FIG. 3D, the cathode side of the DC power supply 31 and the indirect negative electrode 12 are connected by turning the switch 32 of the indirect voltage applying device 30 into the on state from the off state, so that the preset negative voltage is applied to the indirect negative electrode 12. FIG. 3D is a diagram illustrating an outline of the negative voltage applying processing according to the first exemplary embodiment.

Since the electric field is formed within the plating liquid M by this negative voltage applying processing, as illustrated in FIG. 3D, the copper ions C as positively charged particles can be concentrated on the surface of the wafer W, whereas the sulfuric acid ions S as negatively charged particles can be concentrated on the direct electrode 22.

Further, in the negative voltage applying processing, not to allow the direct electrode 22 to serves as the negative electrode and not to allow the wafer W to serve as the positive electrode, the direct electrode 22 and the contact terminals 23 are set in the electrically floating state by controlling both the switch 42 and the switch 43 of the direct voltage applying device 40 to be in the off state.

Accordingly, since exchange of electric charges is suppressed on the entire surfaces of the direct electrode 22 and the wafer W, the charged particles attracted by an electrostatic field are arranged on the surface of the electrode. That is, the copper ions C are collected to be uniformly arranged on the surface of the wafer W by the negative voltage applying processing.

Figure 3E:
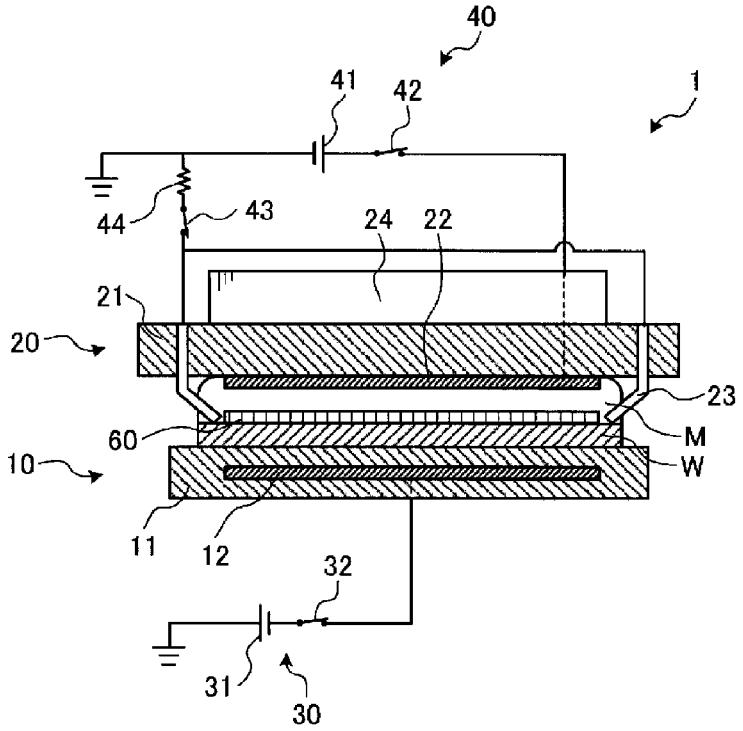
FIG. 3E is a diagram illustrating an outline of an electrolytic treatment according to the first exemplary embodiment.

Upon the completion of the negative voltage applying processing, an electrolytic treatment is performed in the electrolytic treatment apparatus 1. To elaborate, as depicted in FIG. 3E, the switches 42 and 43 of the direct voltage applying device 40 are turned into the on state from the off state at the same time. Accordingly, by applying the voltage to the wafer W and the plating liquid M such that the direct electrode 22 serves as the positive electrode and the wafer W serves as the negative electrode, the electric current is flown between the direct electrode 22 and the wafer W. FIG. 3E is a diagram illustrating an outline of the electrolytic treatment according to the first exemplary embodiment.

Through the electrolytic treatment, the electric charges of the cooper ions C uniformly arranged on the surface of the wafer W are exchanged, and the copper ions C are reduced. As a result, as shown in FIG. 3E, the plating film 60 is precipitated on the surface of the wafer W. Furthermore, though not shown, the sulfuric acid ions S are oxidized by the direct electrode 22 at this time.

As stated above, according to the first exemplary embodiment, since the copper ions C are concentrated on the surface of the wafer W to be reduced in the uniformly arranged manner, the plating film 60 can be uniformly precipitated on the surface of the wafer W. Therefore, according to the first exemplary embodiment, since a density of crystals in the plating film 60 can be increased, it is possible to form the plating film 60 having a high quality on the surface of the wafer W.

Figure 4:
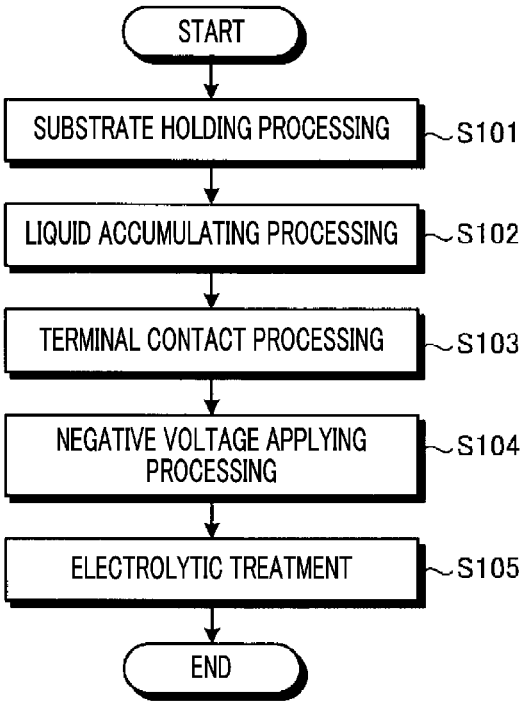
FIG. 4 is a flowchart illustrating a processing sequence in the electrolytic treatment performed in the electrolytic treatment apparatus according to the first exemplary embodiment.

FIG. 4 is a flowchart showing a processing sequence in the electrolytic treatment performed in the electrolytic treatment apparatus 1 according to the first exemplary embodiment. The electrolytic treatment performed in the electrolytic treatment apparatus 1 shown in FIG. 4 is performed as the controller reads out the program stored in the storage and controls the substrate holder 10, the electrolytic processor 20, the indirect voltage applying device 30, the direct voltage applying device 40, the nozzle 50, and so forth based on the read-out commands.

First, the wafer W is transferred to and placed on the substrate holder 10 by using a non-illustrated transfer mechanism. Then, the controller performs the substrate holding processing of holding the wafer W on the substrate holder 10 by controlling the substrate holder 10 (process S101). Subsequently, the controller performs the liquid accumulating processing of accumulating the plating liquid M on the wafer W by controlling the nozzle 50 and the substrate holder 10 (process S102).

In the liquid accumulating processing, the nozzle 50 is first advanced to above the central portion of the wafer W held by the substrate holder 10. Then, while rotating the wafer W by the driver 13, a preset amount of the plating liquid M is supplied onto the central portion of the wafer W from the nozzle 50.

This preset amount is an enough amount to allow the plating liquid M and the direct electrode 22 to come into direct contact with each other when the contact terminals 23 are brought into contact with the wafer W in the subsequent terminal contact processing, for example. After the preset amount of the plating liquid M is supplied, the nozzle 50 is retreated from above the wafer W.

Thereafter, the controller performs the terminal contact processing of bringing the contact terminals 23 into contact with the wafer W by controlling the electrolytic processor 20 (process S103). In the terminal contact processing, the entire electrolytic processor 20 is moved by the moving mechanism 24 to approach the wafer W held by the substrate holder 10, so that the leading ends of the contact terminals 23 are brought into contact with the peripheral portion of the wafer W.

In this terminal contact processing, by bringing the contact terminals 23 close to the wafer W while measuring, for example, a load applied to the contact terminals 23, a contact between the contact terminals 23 and the wafer W can be detected.

According to the first exemplary embodiment, the plating processing is enabled through the liquid accumulating processing and the terminal contact processing as stated above, without immersing the wafer W in an electrolytic bath in which a large amount of the plating liquid M is stored. Therefore, it is possible to form the plating film 60 on the wafer W without using the large amount of the plating liquid M.

Subsequently, the controller performs the negative voltage applying processing of applying the preset negative voltage to the indirect negative electrode 12 by controlling the indirect voltage applying device 30 (process S104). In the negative voltage applying processing, by turning the switch 32 of the indirect voltage applying device 30 into the on state from the off state, the preset negative voltage is applied to the indirect negative electrode 12.

In this negative voltage applying processing, the exchange of the electric charges of the copper ions C is not performed on the surface of the wafer W, and an electrolysis of water is suppressed. Therefore, the electric field intensity can be increased when the voltage is applied between the indirect negative electrode 12 and the direct electrode 22. Therefore, the diffusion rate of the copper ions C can be increased. That is, according to the first exemplary embodiment, since the copper ions C can be gathered on the surface of the wafer W in a short period of time, the growth rate of the plating film 60 can be improved.

Moreover, according to the first exemplary embodiment, by controlling the intensity of the electric field between the indirect negative electrode 12 and the direct electrode 22 as required, the arrangement state of the copper ions C on the surface of the wafer W can be controlled as required.

Furthermore, in the negative voltage applying processing, since an absolute value of the diffusion rate of the copper ions C in the plating liquid M is relatively small, not the negative voltage of the pulse shape but the negative voltage having a constant value needs to be applied to the indirect negative electrode 12. By applying the negative voltage having the constant value to the indirect negative electrode 12, the copper ions C can be efficiently concentrated on the surface of the wafer W.

In the negative voltage applying processing, however, the negative voltage applied to the indirect negative electrode 12 is not limited to having the constant value, but a negative voltage of a pulse shape or a negative voltage having a variable value may be applied.

Next, the controller performs the electrolytic treatment of allowing the electric current to flow between the direct electrode 22 and the wafer W by controlling the direct voltage applying device 40 (process S105). In this electrolytic treatment, by turning on the switches 42 and 43 at the same time, the voltage is applied to the wafer W and the plating liquid M such that the direct electrode 22 serves as the positive electrode and the wafer W serves as the negative electrode.

Through this processing, the electric charges of the copper ions C uniformly arranged on the surface of the wafer W are exchanged, and the copper ions C are reduced. As a result, the plating film 60 is precipitated on the surface of the wafer W. Upon the completion of this electrolytic treatment, the electrolytic treatment (plating processing) upon the wafer W is ended.

Further, in the electrolytic treatment according to the first exemplary embodiment, the voltage needs to be applied in the pulse shape by turning the switches 42 and 43 into the on state or the off state at the same time. Accordingly, the copper ions C can be newly arranged on the surface of the wafer W by the indirect negative electrode 12 when the switches 42 and 43 are in the off state. Therefore, the plating film 60 having a high quality can be efficiently obtained.

In addition, in the first exemplary embodiment, the processings from the liquid accumulating processing of the process S102 to the electrolytic treatment of the process S105 may be repeated. By repeating these processings, the plating film 60 having a larger thickness can be formed.

Second Exemplary Embodiment

Figure 5:
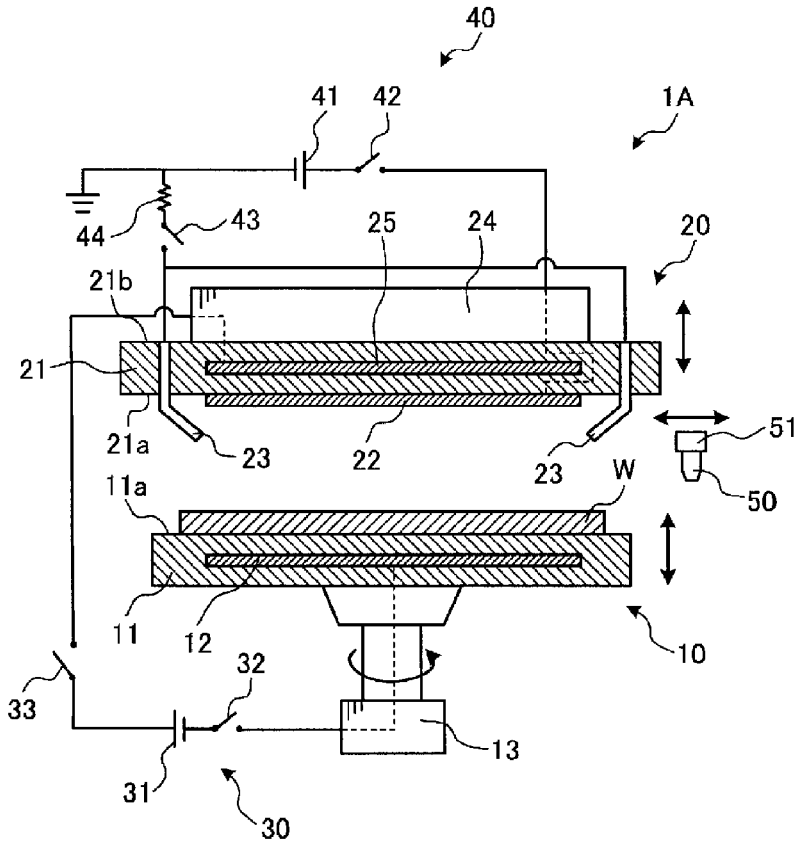
FIG. 5 is diagram illustrating a schematic configuration of an electrolytic treatment apparatus according to a second exemplary embodiment.

Now, referring to FIG. 5, a configuration of an electrolytic treatment apparatus 1A according to a second exemplary embodiment will be explained. The second exemplary embodiment is different from the first exemplary embodiment in parts of the configurations of the electrolytic processor 20 and the indirect voltage applying device 30. Meanwhile, since the other parts of the second exemplary embodiment are the same as those of the first exemplary embodiment, detailed description of the same parts will be omitted.

In the electrolytic treatment apparatus 1A according to the second exemplary embodiment, an indirect positive electrode 25 is provided at the base body 21 of the electrolytic processor 20 in addition to the components of the electrolytic treatment apparatus 1 according to the first exemplary embodiment. This indirect positive electrode 25 is provided within the base body 21 which is made of an insulating material and is not exposed to the outside.

The same as the indirect negative electrode 12, the indirect positive electrode 25 is made of a conductive material and connected to the indirect voltage applying device 30. Meanwhile, unlike the indirect negative electrode 12, a preset positive voltage can be applied to this indirect positive electrode 25. By way of example, the indirect positive electrode 25 has the substantially same size as the direct electrode 22 when viewed from the top, and is disposed substantially in parallel with the wafer W held on the top surface 11*a* of the substrate holder 11.

The indirect voltage applying device 30 includes the DC power supply 31, the switch 32 and a switch 33. The cathode side of the DC power supply 31 is connected to the indirect negative electrode 12 via the switch 32, and the anode side of the DC power supply 31 is connected to the indirect positive electrode 25 via the switch 33.

By turning the switch 32 on, the indirect voltage applying device 30 is capable of applying the preset negative voltage to the indirect negative electrode 12. Further, by turning the switch 33 on, the indirect voltage applying device 30 is capable of applying the preset positive voltage to the indirect positive electrode 25.

Now, referring to FIG. 6A and FIG. 6B, details of a plating processing as an example of an electrolytic treatment performed in the electrolytic treatment apparatus 1A according to the second exemplary embodiment will be described. In the plating processing performed in the electrolytic treatment apparatus 1A according to the second exemplary embodiment, the substrate holding processing, the liquid accumulating processing and the terminal contact processing are performed in sequence, the same as in the first exemplary embodiment. Detailed description of these processings will be omitted here.

Figure 6A:
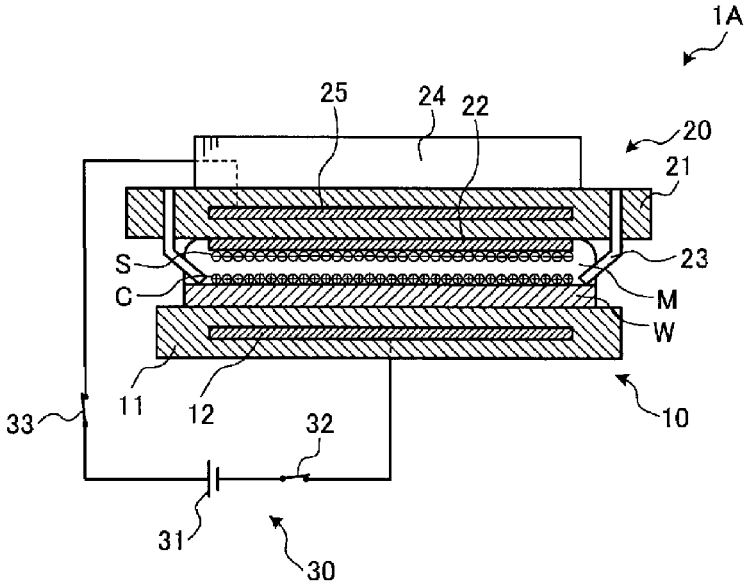
FIG. 6A is a diagram illustrating an outline of a negative voltage applying processing and a positive voltage applying processing according to the second exemplary embodiment.
Figure 6B:
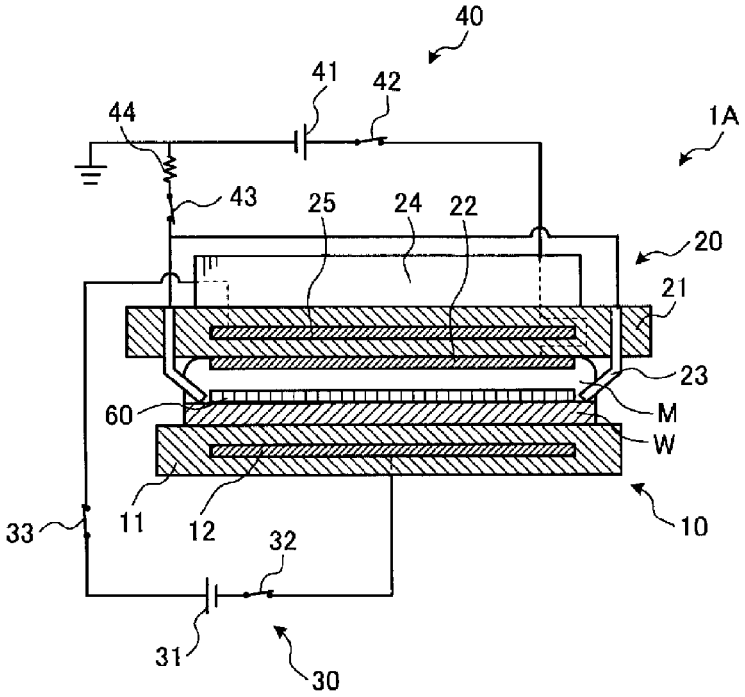
FIG. 6B is a diagram illustrating an outline of an electrolytic treatment according to the second exemplary embodiment.

Following the terminal contact processing, in the electrolytic treatment apparatus 1A, a negative voltage applying processing and a positive voltage applying processing are performed in parallel, as shown in FIG. 6A. FIG. 6A is a diagram illustrating an outline of the negative voltage applying processing and the positive voltage applying processing according to the second exemplary embodiment.

To elaborate, while connecting the cathode side of the DC power supply 31 and the indirect negative electrode 12 by turning the switch 32 of the indirect voltage applying device 30 into the on state from the off state, the preset negative voltage is applied to the indirect negative electrode 12 (negative voltage applying processing). Further, by turning the switch 33 into the on state from the off state at the same time as the switch 32 is turned into the on state from the off state, the anode side of the DC power supply 31 and the indirect positive electrode 25 are connected, and the preset positive voltage is applied to the indirect positive electrode 25 (positive voltage applying processing).

Since the electric field is formed within the plating liquid M through the negative voltage applying processing and the positive voltage applying processing, the copper ions C as the positively charged particles can be concentrated on the surface of the wafer W, whereas the sulfuric acid ions S as the negatively charged particles can be concentrated on the direct electrode 22, as shown in FIG. 6A.

Following the negative voltage applying processing and the positive voltage applying processing, the electrolytic treatment is performed in the electrolytic treatment apparatus 1A, the same as in the first exemplary embodiment. Accordingly, the electric charges of the copper ions C uniformly arranged on the surface of the wafer W are exchanged, and the copper ions C are reduced. As a result, the plating film 60 is precipitated on the surface of the wafer W, as shown in FIG. 6B. FIG. 6B is a diagram illustrating an outline of the electrolytic treatment according to the second exemplary embodiment.

In the second exemplary embodiment described so far, the negative voltage applying processing suppresses the opening of the via 70 from being clogged by the plating film 60 before the inside of the via 70 is filled with the plating film 60, the same as in the first exemplary embodiment. Thus, the via 70 formed in the wafer W can be filled with the plating film 60 successfully.

Furthermore, in the second exemplary embodiment, by performing the negative voltage applying processing and the positive voltage applying processing in parallel, the larger electric field can be formed within the plating liquid M. Therefore, since the diffusion rate of the copper ions C within the plating liquid M can be increased, the copper ions C can be gathered on the surface of the wafer Win a short period of time. Hence, according to the second exemplary embodiment, the growth rate of the plating film 60 can be improved.

Figure 7:
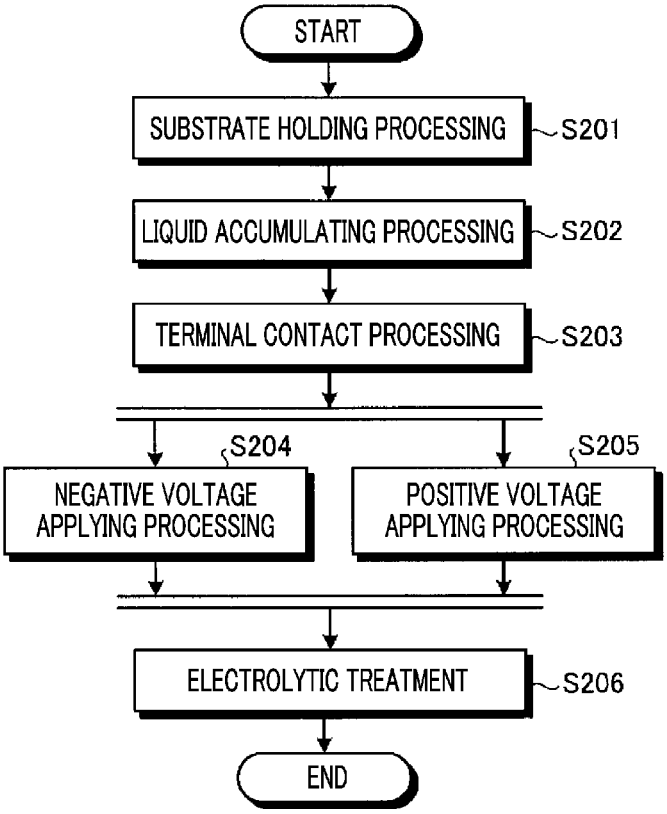
FIG. 7 is a flowchart illustrating a processing sequence in the electrolytic treatment performed in the electrolytic treatment apparatus according to the second exemplary embodiment.

FIG. 7 is a flowchart showing a processing sequence in the electrolytic treatment performed in the electrolytic treatment apparatus 1A according to the second exemplary embodiment. The electrolytic treatment performed in the electrolytic treatment apparatus 1A shown in FIG. 7 is performed as the controller reads out the program stored in the storage and controls the substrate holder 10, the electrolytic processor 20, the indirect voltage applying device 30, the direct voltage applying device 40, the nozzle 50, and so forth based on the read-out commands.

First, the wafer W is transferred to and placed on the substrate holder 10 by using the non-illustrated transfer mechanism. Then, the controller performs a substrate holding processing of holding the wafer W on the substrate holder 10 by controlling the substrate holder 10 (process S201). Subsequently, the controller performs the liquid accumulating processing of accumulating the plating liquid M on the wafer W by controlling the nozzle 50 and the substrate holder 10 (process S202).

In the liquid accumulating processing, the nozzle 50 is first advanced to above the central portion of the wafer W held by the substrate holder 10. Then, while rotating the wafer by the driver 13, the preset amount of the plating liquid M is supplied onto the central portion of the wafer W from the nozzle 50.

This preset amount is an enough amount to allow the plating liquid M and the direct electrode 22 to come into direct contact with each other when contact terminals 23 are brought into contact with the wafer W in the subsequent terminal contact processing, for example. After the preset amount of the plating liquid M is supplied, the nozzle 50 is retreated from above the wafer W.

Thereafter, the controller performs the terminal contact processing of bringing the contact terminals 23 into contact with the wafer W by controlling the electrolytic processor 20 (process S203). In the terminal contact processing, the entire electrolytic processor 20 is moved by the moving mechanism 24 to approach the wafer W held by the substrate holder 10, so that the leading end portions of the contact terminals 23 are brought into contact with the peripheral portion of the wafer W.

Then, the controller performs the negative voltage applying processing of applying the preset negative voltage to the indirect negative electrode 12 by controlling the indirect voltage applying device 30 (process S204). In this negative voltage applying processing, by turning the switch 32 of the indirect voltage applying device 30 into the on state from the off state, the preset negative voltage is applied to the indirect negative electrode 12.

Further, in parallel with this negative voltage applying processing, the controller performs the positive voltage applying processing of applying the preset positive voltage to the indirect positive electrode 25 by controlling the indirect voltage applying device 30 (process S205). In this positive voltage applying processing, by turning the switch 33 of the indirect voltage applying device 30 into the on state from the off state, the preset positive voltage is applied to the indirect positive electrode 25.

Further, in the negative voltage applying processing and the positive voltage applying processing, not the negative voltage of the pulse shape and the positive voltage of the pulse shape but the negative voltage having a constant value and the positive voltage having a constant value need to be respectively applied to the indirect negative electrode 12 and the indirect positive electrode 25 the same as in the first exemplary embodiment. In this way, by applying the negative voltage of the constant value to the indirect negative electrode 12 and the positive voltage of the constant value to the indirect positive electrode 25, the copper ions C can be concentrated on the surface of the wafer W efficiently.

However, the negative voltage applied to the indirect negative electrode 12 in the negative voltage applying processing and the positive voltage applied to the indirect positive electrode 25 in the positive voltage applying processing are not limited to having the constant value, but a voltage of a pulse shape or a voltage having a variable value may be applied thereto.

Subsequently, the controller performs an electrolytic treatment of allowing the electric current to flow between the direct electrode 22 and the wafer W by controlling the direct voltage applying device 40 (process S206). In this electrolytic treatment, by turning on the switches 42 and 43 at the same time, the voltage is applied to the wafer W and the plating liquid M such that the direct electrode 22 serves as the positive electrode and the wafer W serves as the negative electrode.

Through this processing, the electric charges of the copper ions C uniformly arranged on the surface of the wafer W are exchanged, and the copper ions C are reduced. As a result, the plating film 60 is precipitated on the surface of the wafer W. Upon the completion of this electrolytic treatment, the electrolytic treatment (plating processing) upon the wafer W is ended.

So far, the exemplary embodiments of the present disclosure have been described. However, it should be noted that the exemplary embodiments are not limiting and various changes and modifications may be made without departing from the scope of the present disclosure. By way of example, in the above-described exemplary embodiments, the plating liquid M and the wafer W are made to come into contact with each other by accumulating the plating liquid M on the wafer W. However, the plating liquid M and the wafer W may be brought into contact with each other by immersing the wafer W in the electrolytic bath in which the plating liquid M is stored.

Furthermore, although the exemplary embodiments have been described for the examples where the plating processing is performed as the electrolytic treatment, the present disclosure may be applicable to various other kinds of electrolytic treatments such as an etching processing.

In addition, although the exemplary embodiments have been described for the examples where the copper ions C are reduced on the surface of the wafer W, the present disclosure may be applicable to oxidizing target ions on the surface of the wafer W. In such a case, in view of the fact that the target ions are negative ions, the electrolytic treatment needs to be performed by reversing the positive electrode and the negative electrode in the above-described exemplary embodiments. With such a configuration, although there is a difference in whether the oxidation of the target ions takes place or the reduction of the target ions takes place, the same effects as obtained in the above-described exemplary embodiments can also be achieved.

The electrolytic treatment apparatus 1 (1A) according to the exemplary embodiments is configured to perform the electrolytic treatment on a target substrate (wafer W), and is equipped with the substrate holder 10 and the electrolytic processor 20. The substrate holder 10 is equipped with: the insulating holding body 11 configured to hold the target substrate (wafer W); and the indirect negative electrode 12 disposed within the holding body 11. A negative voltage is applied to the indirect negative electrode 12. The electrolytic processor 20 is disposed to face the substrate holder 10 and configured to apply a voltage to the target substrate (wafer W) and an electrolyte (plating liquid M) in contact with the target substrate (wafer W). Therefore, the via 70 formed in the wafer W can be filled with the plating film 60 successfully.

Further, in the electrolytic treatment apparatus 1 (1A) according to the exemplary embodiments, the negative voltage having the constant value is applied to the indirect negative electrode 12. Accordingly, the copper ions C can be concentrated on the surface of the wafer W efficiently.

Besides, in the electrolytic treatment apparatus 1A according to the exemplary embodiment, the electrolytic processor 20 is equipped with the insulating base body 21 and the indirect positive electrode 25 disposed within the base body 21. The positive voltage is applied to the indirect positive electrode 25. With this configuration, the growth rate of the plating film 60 can be increased.

Moreover, in the electrolytic treatment apparatus 1A according to the exemplary embodiment, the positive voltage having the constant value is applied to the indirect positive electrode 25. Accordingly, the copper ions C can be concentrated on the surface of the wafer W efficiently.

In addition, in the electrolytic treatment apparatus 1 (1A) according to the exemplary embodiments, the electrolytic processor 20 is equipped with the direct electrode 22 disposed to face the target substrate (wafer W) and the contact terminals 23 configured to be brought into contact with the target substrate (wafer W). With this configuration, the plating processing can be carried out by performing the liquid accumulating processing on the wafer W, so that the plating film 60 can be formed on the wafer W without using a large amount of the plating liquid M.

Furthermore, in the electrolytic treatment apparatus 1 (1A) according to the exemplary embodiments, the positive voltage of the pulse shape is applied to the direct electrode 22, and the negative voltage of the pulse shape is applied to the contact terminals 23. Accordingly, the plating film 60 having a high quality can be formed efficiently.

Additionally, the electrolytic treatment method according to the present exemplary embodiments is a method of performing the electrolytic treatment on the target substrate (wafer W) by using the electrolytic treatment apparatus 1 (1A) including: the substrate holder 10 equipped with the insulating holding body 11 configured to hold the target substrate (wafer W) and the indirect negative electrode 12 disposed within the holding body 11, the negative voltage being applied to the indirect negative electrode 12; and the electrolytic processor 20 disposed to face the substrate holder 10 and configured to apply a voltage to the target substrate (wafer W) and the electrolyte (plating liquid M) in contact with the target substrate (wafer W). This electrolytic treatment method includes: holding the target substrate (wafer W) by the substrate holder 10 (process S101 (S201)); accumulating the electrolyte (plating liquid M) on the target substrate (wafer W) (process S102 (S202)); applying the negative voltage to the indirect negative electrode 12 (process S104 (S204)); and applying the voltage to the target substrate (wafer W) and the electrolyte (plating liquid M) by the electrolytic processor 20 (process S105 (S206)). Through these processes, the via 70 formed in the wafer W can be filled with the plating film 60 successfully.

Furthermore, the electrolytic treatment method according to the present exemplary embodiments is a method of performing the electrolytic treatment on the target substrate (wafer W) by using the electrolytic treatment apparatus 1A including: the substrate holder 10 equipped with the insulating holding body 11 configured to hold the target substrate (wafer W) and the indirect negative electrode 12 disposed within the holding body 11, the negative voltage being applied to the indirect negative electrode 12; and the electrolytic processor 20 disposed to face the substrate holder 10 and configured to apply a voltage to the target substrate (wafer W) and the electrolyte (plating liquid M) in contact with the target substrate (wafer W), the electrolytic processor 20 comprising the insulating base body 21 and the indirect positive electrode 25 disposed within the base body 21, the positive voltage being applied to the indirect positive electrode 25. This electrolytic treatment method includes: holding the target substrate (wafer W) by the substrate holder 10 (process S201); accumulating the electrolyte (plating liquid M) on the target substrate (wafer W) (process S202); applying the negative voltage to the indirect negative electrode 12 (process S204); applying the positive voltage to the indirect positive electrode 25 (process S205); and applying the voltage to the target substrate (wafer W) and the electrolyte (plating liquid M) by the electrolytic processor 20 (process S206). Through these processes, the via 70 formed in the wafer W can be filled with the plating film 60 successfully, and the growth rate of the plating film 60 in the electrolytic treatment can be improved.

Additionally, in the electrolytic treatment methods according to the exemplary embodiments, the electrolytic processor 20 includes the direct electrode 22 disposed to face the target substrate (wafer W) and the contact terminals 23 configured to be brought into contact with the target substrate (wafer W). With this configuration, bringing the contact terminals 23 into contact with the target substrate (wafer W) (process S103 (S203)) is performed after the accumulating of the electrolyte on the target substrate (process S102 (S202)). Accordingly, the plating film 60 can be formed on the wafer W without using a large amount of the plating liquid M.

Furthermore, in the electrolytic treatment methods according to the exemplary embodiments, in the applying of the voltage to the target substrate (wafer W) and the electrolyte (plating liquid M) (process S105 (S206)) after bringing of the contact terminals 23 into contact with the target substrate (wafer W) (process S103 (S203)), the positive voltage of the pulse shape is applied to the direct electrode 22, and the negative voltage of the pulse shape is applied to the contact terminals 23. Accordingly, the plating film 60 having a high quality can be formed efficiently.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting. The scope of the inventive concept is defined by the following claims and their equivalents rather than by the detailed description of the exemplary embodiments. It shall be understood that all modifications and embodiments conceived from the meaning and scope of the claims and their equivalents are included in the scope of the inventive concept.

According to the exemplary embodiment as stated above, it is possible to fill the via formed in the wafer with the plating film successfully.

We claim:

1. An electrolytic treatment apparatus configured to perform an electrolytic treatment on a target substrate, the electrolytic treatment apparatus comprising:

a substrate holder comprising an insulating holding body configured to hold the target substrate and an indirect negative electrode disposed within the insulating holding body, a negative voltage being applied to the indirect negative electrode by a cathode side of a power supply connected to the indirect negative electrode;

an electrolytic processor disposed to face the substrate holder, comprising an indirect positive electrode, and configured to apply a voltage to the target substrate and an electrolyte in contact with the target substrate by an anode side of the power supply connected to the indirect positive electrode;

a nozzle provided between the substrate holder and the electrolytic processor, and configured to supply the electrolyte onto the target substrate held by the insulating holding body; and a driver configured to rotate the insulating holding body to diffuse the electrolyte on a top surface of the target substrate.

2. The electrolytic treatment apparatus of claim 1, wherein the negative voltage having a constant value is applied to the indirect negative electrode.

3. The electrolytic treatment apparatus of claim 1, wherein the electrolytic processor comprises:

an insulating base body, and wherein the indirect positive electrode is disposed within the base body, a positive voltage being applied to the indirect positive electrode.

4. The electrolytic treatment apparatus of claim 3, wherein the positive voltage having a constant value is applied to the indirect positive electrode.

5. The electrolytic treatment apparatus of claim 1, wherein the electrolytic processor comprises:

a direct electrode disposed to face the target substrate; and contact terminals configured to be brought into contact with the target substrate.

6. The electrolytic treatment apparatus of claim 5, wherein a positive voltage of a pulse shape is applied to the direct electrode, and a negative voltage of a pulse shape is applied to the contact terminals.

7. The electrolytic treatment apparatus of claim 2, wherein the electrolytic processor comprises:

an insulating base body; and the indirect positive electrode is disposed within the base body, a positive voltage being applied to the indirect positive electrode.

8. The electrolytic treatment apparatus of claim 7, wherein the positive voltage having a constant value is applied to the indirect positive electrode.

9. The electrolytic treatment apparatus of claim 8, wherein the electrolytic processor comprises:

a direct electrode disposed to face the target substrate; and contact terminals configured to be brought into contact with the target substrate.

10. The electrolytic treatment apparatus of claim 9, wherein a positive voltage of a pulse shape is applied to the direct electrode, and a negative voltage of a pulse shape is applied to the contact terminals.

11. The electrolytic treatment apparatus of claim 4, wherein the electrolytic processor comprises:

a direct electrode disposed to face the target substrate; and contact terminals configured to be brought into contact with the target substrate.

12. The electrolytic treatment apparatus of claim 11, wherein a positive voltage of a pulse shape is applied to the direct electrode, and a negative voltage of a pulse shape is applied to the contact terminals.

13. An electrolytic treatment method of performing an electrolytic treatment on a target substrate by using an electrolytic treatment apparatus comprising: a substrate holder comprising an insulating holding body configured to hold the target substrate and an indirect negative electrode disposed within the insulating holding body, a negative voltage being applied to the indirect negative electrode by connecting a cathode side of a power supply to the indirect negative electrode; an electrolytic processor disposed to face the substrate holder, comprising an indirect positive electrode, and configured to apply a voltage to the target substrate and an electrolyte in contact with the target substrate by connecting an anode side of the power supply to the indirect positive electrode; a nozzle provided between the substrate holder and the electrolytic processor, and configured to supply the electrolyte onto the target substrate held by the insulating holding body; and a driver configured to rotate the insulating holding body to diffuse the electrolyte on a top surface of the target substrate, the electrolytic treatment method comprising:

holding the target substrate by the substrate holder;

accumulating the electrolyte on the target substrate by the nozzle and the driver;

applying the negative voltage to the indirect negative electrode; and applying the voltage to the target substrate and the electrolyte by the electrolytic processor.

14. The electrolytic treatment method of claim 13, wherein the electrolytic processor comprises:

a direct electrode disposed to face the target substrate; and contact terminals configured to be brought into contact with the target substrate, and wherein bringing the contact terminals into contact with the target substrate is performed after the accumulating of the electrolyte on the target substrate.

15. The electrolytic treatment method of claim 14, wherein, in the applying of the voltage to the target substrate and the electrolyte after the bringing of the contact terminals into contact with the target substrate, a positive voltage of a pulse shape is applied to the direct electrode, and a negative voltage of a pulse shape is applied to the contact terminals.

16. An electrolytic treatment method of performing an electrolytic treatment on a target substrate by using an electrolytic treatment apparatus comprising: a substrate holder comprising an insulating holding body configured to hold the target substrate and an indirect negative electrode disposed within the insulating holding body, a negative voltage being applied to the indirect negative electrode by connecting a cathode side of a power supply to the indirect negative electrode; an electrolytic processor disposed to face the substrate holder, comprising an indirect positive electrode, and configured to apply a voltage to the target substrate and an electrolyte in contact with the target substrate by connecting an anode side of the power supply to the indirect positive electrode; a nozzle provided between the substrate holder and the electrolytic processor, and configured to supply the electrolyte onto the target substrate held by the insulating holding body; and a driver configured to rotate the insulating holding body to diffuse the electrolyte on a top surface of the target substrate, the electrolytic processor comprising an insulating base body and an indirect positive electrode disposed within the base body, a positive voltage being applied to the indirect positive electrode, the electrolytic treatment method comprising:

holding the target substrate by the substrate holder;

accumulating the electrolyte on the target substrate by the nozzle and the driver;

applying the negative voltage to the indirect negative electrode;

applying the positive voltage to the indirect positive electrode; and applying a voltage to the target substrate and the electrolyte by the electrolytic processor.

17. The electrolytic treatment method of claim 16, wherein the electrolytic processor comprises:

a direct electrode disposed to face the target substrate; and contact terminals configured to be brought into contact with the target substrate, and wherein bringing the contact terminals into contact with the target substrate is performed after the accumulating of the electrolyte on the target substrate.

18. The electrolytic treatment method of claim 17, wherein, in the applying of the voltage to the target substrate and the electrolyte after the bringing of the contact terminals into contact with the target substrate, a positive voltage of a pulse shape is applied to the direct electrode, and a negative voltage of a pulse shape is applied to the contact terminals.

* * * * *